US006907660B2

(12) United States Patent
Astner

(10) Patent No.: US 6,907,660 B2
(45) Date of Patent: Jun. 21, 2005

(54) METHOD OF MOUNTING A CAMSHAFT ON THE CYLINDER HEAD OF AN INTERNAL COMBUSTION ENGINE

(75) Inventor: Josef Astner, Kernen-Stetten (DE)

(73) Assignee: DaimlerChrysler A.G., Stuttgart (DE)

( * ) Notice: Subject to any disclaimer, the term of this patent is extended or adjusted under 35 U.S.C. 154(b) by 229 days.

(21) Appl. No.: 10/270,986

(22) Filed: Oct. 15, 2002

(65) Prior Publication Data

US 2003/0072508 A1 Apr. 17, 2003

(51) Int. Cl.[7] ..... B21K 3/00; F16C 35/00

(52) U.S. Cl. ..... 29/888.01; 29/888.1; 123/90.27; 384/433

(58) Field of Search ..... 29/888.01, 888.1, 29/464, 898.07; 123/90.6, 90.27; 384/433; 74/567, 595

(56) References Cited

U.S. PATENT DOCUMENTS

| | | | | | |
|---|---|---|---|---|---|
| 4,843,697 | A | * | 7/1989 | Marshall | 29/888.01 |
| 5,224,804 | A | * | 7/1993 | Shepley | 409/244 |
| 6,024,063 | A | * | 2/2000 | Muter et al. | 123/90.27 |
| 2002/0073546 | A1 | * | 6/2002 | Thompson | 29/898 |
| 2002/0185094 | A1 | * | 12/2002 | Yoon | 123/90.38 |

FOREIGN PATENT DOCUMENTS

| | | |
|---|---|---|
| DE | 43 23 073 A 1 | 1/1995 |
| DE | 43 24 791 A 1 | 1/1995 |
| DE | 196 03 692 A 1 | 8/1997 |
| DE | 198 35 593 A 1 | 2/2000 |
| DE | 198 37 586 A 1 | 2/2000 |

* cited by examiner

*Primary Examiner*—Marc Jimenez
(74) *Attorney, Agent, or Firm*—Klaus J. Bach

(57) ABSTRACT

In an arrangement and method for mounting a camshaft onto a cylinder head of an internal combustion engine by camshaft bearings disposed on the cylinder head of the engine camshaft bearing by support seats which are formed integrally with the cylinder head and bearing caps which are formed integrally with a cylinder head cover mounted onto the cylinder head, at least one of the bearings is an assembly bearing with a separate assembly bearing cap that has a bearing opening of a diameter greater than that of the camshaft so that the camshaft when placed onto the bearing seats is not fully moved into the bearing seat openings but is fully engaged with the bearing seats only when the cylinder head cover is mounted onto the cylinder head whereby the camshaft in the assembly bearing is moved out of contact with the assembly bearing cap.

4 Claims, 2 Drawing Sheets

METHOD OF MOUNTING A CAMSHAFT ON THE CYLINDER HEAD OF AN INTERNAL COMBUSTION ENGINE

BACKGROUND OF THE INVENTION

The invention resides in an arrangement and a method of mounting a camshaft on the cylinder head of an internal combustion engine with camshaft bearings comprising bearing seats which are formed from the cylinder head and bearing caps formed on the cylinder head cover, wherein a camshaft is mounted by at least one separate bearing cap before the cylinder head cover is mounted in place on the cylinder head.

Such an arrangement for the mounting of a camshaft on the cylinder head of an internal combustion engine and a method of mounting are known from DE 198 37 586 A1. The publication discloses a cylinder head arrangement of an internal combustion engine comprising a cylinder head, a bearing structure for supporting a camshaft by way of camshaft bearings and a cylinder head cover. The camshaft bearings include each a bearing seat and a bearing cap. The bearing seats are formed integrally with the cylinder head and the bearing caps are formed integrally with the cylinder head cover. In order to fix the camshaft on the cylinder head before the mounting of the cylinder head cover on the cylinder head, at least one separate bearing cap is provided which is mounted onto the respective bearing seat of the cylinder head whereby one camshaft bearing is completed. When the camshaft is fixed in position on the cylinder head by the separate bearing cap, the cylinder head cover can be mounted onto the cylinder head in a conventional manner, whereby, at the same time, the other camshaft bearings are completed by the bearing covers integrally formed with the cylinder head cover.

The manufacturing and assembly procedure of such an engine generally follows the following steps:

The cylinder head is prepared, the separate bearing coves are mounted onto the cylinder head and finally, the cylinder head cover is bolted onto the cylinder head. Then the camshaft bearing bore is drilled. Subsequently the cylinder head cover is again removed and the separate bearing caps are marked. The bearing caps are left on the cylinder head, which is passed on for engine assembly.

Upon engine assembly, the separate bearing caps are removed and the cylinder head is mounted onto the engine block. The camshaft is placed into the bearing seats and, for fixing the camshaft, the separate, marked bearing caps are mounted exactly as marked and are bolted down. Subsequently, the chain drive for the camshaft is installed. Then the crankshaft is rotated to check operation of the drive and finally the cylinder head cover is placed onto the assembled cylinder head and is bolted down, whereby, at the same time, the other camshaft bearings are formed. The camshaft is in that case fixed in position by the mounting of the separate bearing caps. However, the working and pairing of the separate bearing caps requires a relatively large amount of time and effort.

For general technical background information, reference is made to DE 43 24 791 A1, DE 196 03 692 A1, DE 43 23 073 A1 and DE 198 35 593 A1.

It is the object of the present invention to provide an arrangement and a method for the assembly of an internal combustion engine wherein the installation of the camshaft is simplified.

SUMMARY OF THE INVENTION

In an arrangement and method for mounting a camshaft onto a cylinder head of an internal combustion engine by camshaft bearings disposed on the cylinder head of the engine camshaft bearing by support seats which are formed integrally with the cylinder head and bearing caps which are formed integrally with a cylinder head cover mounted onto the cylinder head, at least one of the bearings is an assembly bearing with a separate assembly bearing cap that has a bearing opening of a diameter greater than that of the camshaft so that the camshaft when placed onto the bearing seats is not fully moved into the bearing seat openings but is fully engaged with the bearing seats only when the cylinder head cover is mounted onto the cylinder head whereby the camshaft in the assembly bearing is moved out of contact with the assembly bearing cap.

An essential advantage of the invention is that, for fixing the camshaft on the cylinder head, no use is made of camshaft bearings, which must be machined in a paired manner with the cylinder head cover mounted and which must later be used during assembly as they were machined on the cylinder head. Consequently the machining and pairing efforts for these bearing parts is eliminated. An assembly bearing comprises a separate bearing seat and an associated separate bearing cap. The assembly bearing cap has a larger bearing opening diameter than a camshaft bearing cap. Since, as a result, an unpaired installation of the assembly bearings is possible, the assembly bearing caps can be indiscriminately taken during assembly from a box just like bolts or other small parts.

With the use of assembly bearings for the first fixing of the camshaft furthermore a visual control possibility is provided which is independent of the machining of the camshaft bearings.

Also, with respect to construction space requirements, the assembly bearing caps made of sheet steel or of plastic offer a clear advantage since they are essentially smaller than separate full service camshaft bearing caps which generally consist of aluminum.

Furthermore, the manufacture of these assembly bearing caps is more advantageous than the manufacture of separate bearing caps made to measure which consist for example of aluminum die castings.

The invention will become more readily apparent from the following description of a particular embodiment thereof on the basis of the accompanying drawings.

DESCRIPTION OF A PREFERRED EMBODIMENT

Figure 1:
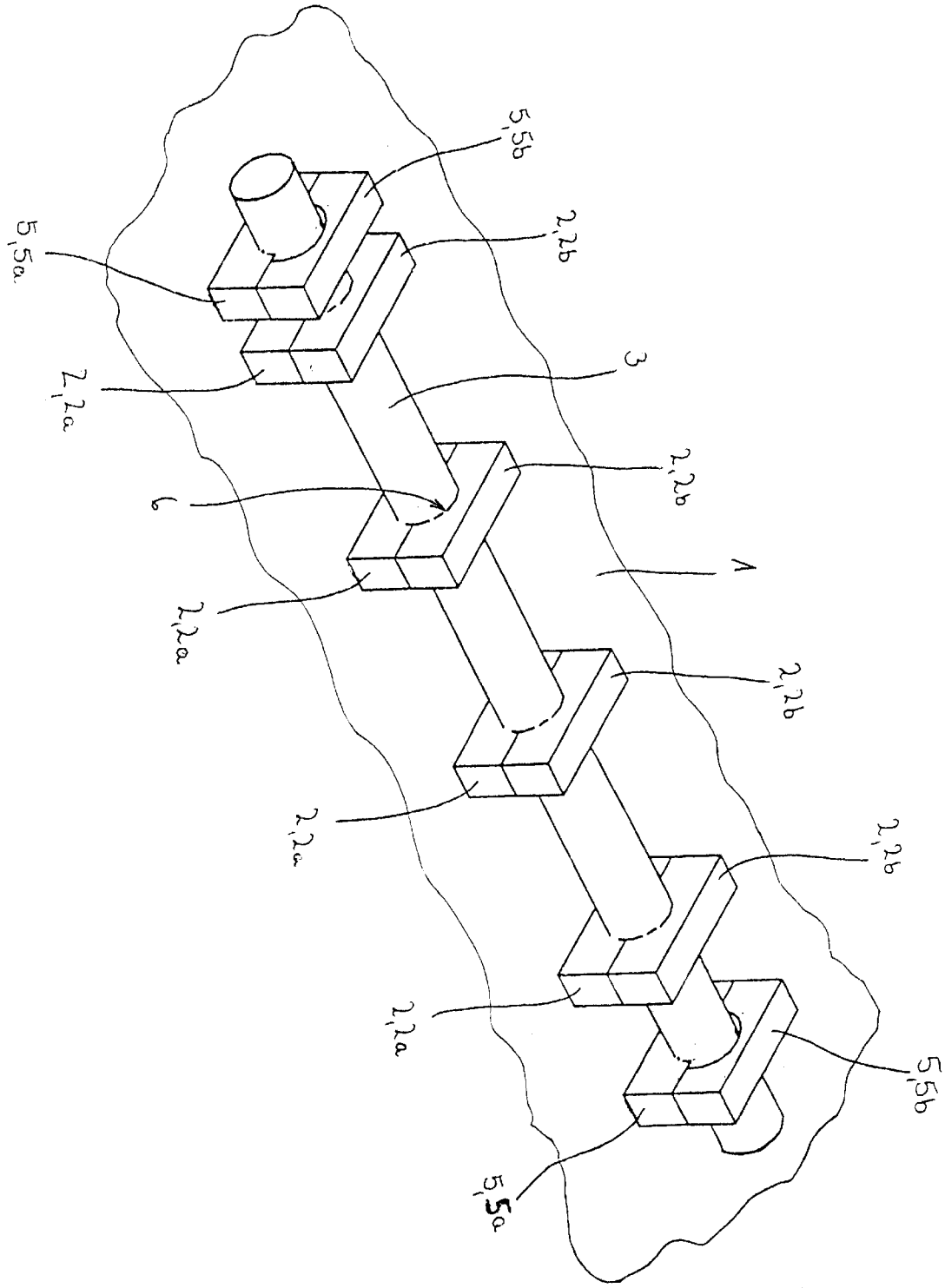
FIG. 1 shows, in a schematic representation, the mounting arrangement according to the invention for the camshaft of an internal combustion engine, which includes bearing caps formed with the cylinder head cover and bearing seats formed integrally with the cylinder head and also assembly bearings for fixing the camshaft before the mounting of the cylinder head cover.
Figure 3:
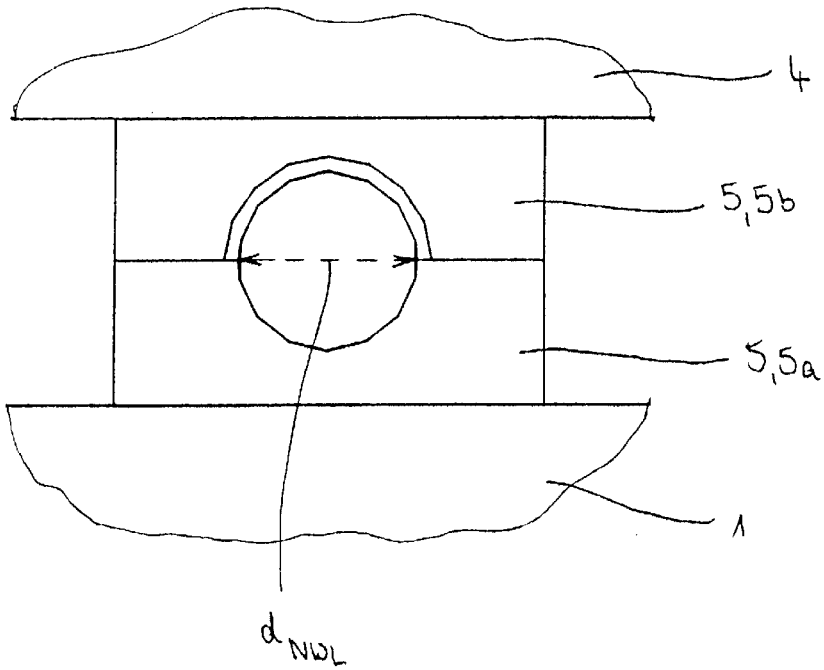
FIG. 3 is the same front view of the assembly bearing after the mounting of the cylinder head cover.

FIG. 1 shows the top of the cylinder head 1 of an internal combustion engine with camshaft bearings 2 for supporting at least one camshaft 3. In FIG. 3, a cylinder head cover 4 is schematically shown which covers the cylinder head 1 and the camshaft 3. The camshaft bearings 2 include each a bearing seat 2*a* and a bearing cap 2*b*. The bearing seats 2*a* are formed integrally with the cylinder head 1 and the bearing caps 2*b* are formed integrally with the cylinder head cover 4.

Before the installation of the cylinder head cover 4, the camshaft 3 can be fixed in position by at least one separate, that is, an independent bearing cap 5*b* to a corresponding bearing seat 5*a* which is formed integrally with the cylinder head 1. In accordance with the invention, the separate bearing cap 5*b* is part of an assembly bearing 5 and cooperates with a bearing seat 5*a*, corresponding to the camshaft bearing seat 2*a*. The bearing diameter $d_{ML}$ of the assembly bearing cap 5*b* (FIG. 2) is larger than the bearing diameter $d_{NWL}$ of the camshaft bearing cap 2*b* (FIG. 3). However, the assembly bearing seat 5*a* of the assembly bearing 5 has the same diameter as the bearing caps 2*a* of the camshaft bearing 2.

In the arrangement as shown, the camshaft 3 is held in position on the cylinder head on the respective bearing seats 5*a* by two assembly bearing caps 5*b*, which are arranged at the opposite axial ends of the camshaft 3. Preferably, the assembly bearing caps 5*b* consist of sheet steel or of plastic. The manufacturing and assembling procedures of the arrangement according to the invention are as follows:

The cylinder head is preliminarily machined. Then the cylinder head cover 4 is bolted onto the cylinder head 1 and the camshaft bearing bore 6 is drilled. Prepared in this way, the cylinder head 1 is transferred to the assembly stage.

For assembly, the cylinder head cover 4 is removed and the cylinder head is mounted onto an engine block which is not shown herein. Then the camshaft is placed into the bearing seats 2*a*, 5*a*, and the separate bearing caps 5*b*, that is, the assembly bearing caps are positioned on the assembly bearing seats 5*a* and bolted down.

Figure 2:
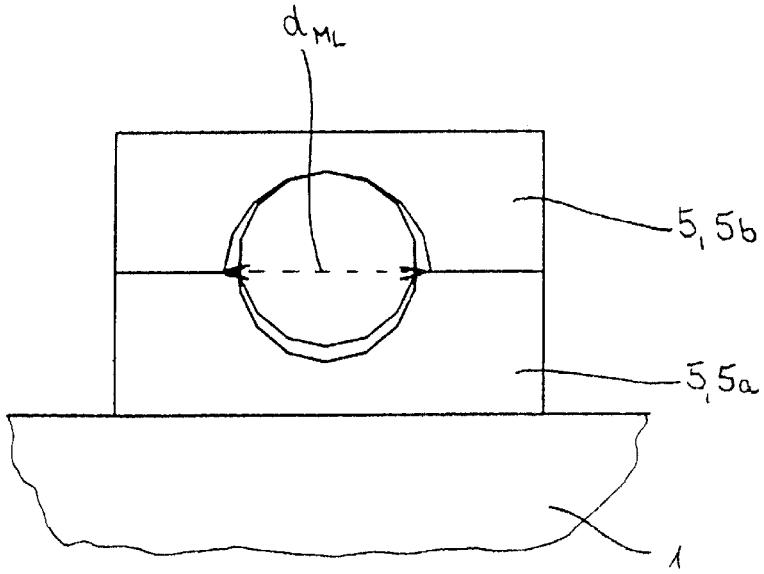
FIG. 2 is a front view of an assembly bearing before the mounting of the cylinder head cover.

As shown in FIG. 2, after the mounting of the bearing cap 5*b*, the camshaft is still supported in the respective bearing seat 5*a* with some play. Then the camshaft drive, for example, a chain drive, which is not shown, is installed. The crankshaft is rotated for checking and subsequently the cylinder head cover 4 is placed onto the cylinder head and bolted thereto.

FIG. 3 shows that, only with the assembly of the cylinder head cover 4, the camshaft 3 is pressed into the bearing seat 5*a* of the assembly bearing 5 for final fixing of the camshaft 3. At the same time, the remaining camshaft bearings 2 are completed with the bearing caps 2*b* integrally formed with the cylinder head cover 4. From hereon, the camshaft 3 is fully engaged in the bearing bores 6 of the bearings 2 and the assembly bearing caps 5*b* are no longer in contact with the camshaft 3. The assembly bearing caps 5*b* however remain on the cylinder head 1 so that the camshaft 3 is held in position if, by any chance, the cylinder head cover 4—together with the integrally formed bearing caps—is removed from the cylinder head 1.

What is claimed is:

1. A method of mounting a camshaft onto cylinder head of an internal combustion engine covered by a cylinder head cover, wherein said cylinder head comprises camshaft bearings for supporting a camshaft, and each camshaft bearing includes a bearing support seat formed integrally with the cylinder head and a bearing cap formed integrally with the cylinder head cover, and at least one of the bearing support seats is an assembly bearing seat and its bearing cap is a separate assembly bearing cap with a bearing opening larger in diameter than said camshaft whereby the camshaft can be held on the cylinder head while the cylinder head cover is removed from said cylinder head, said method comprising the steps of: placing said camshaft onto said bearing seats, installing said assembly bearing cap on said assembly bearing seat such that said camshaft is held on said bearing seats with play between the bearing seats and the camshaft and then mounting the cylinder head cover onto the cylinder head whereby said camshaft is fully engaged with said bearing seats and moved out of contact with said assembly bearing cap.

2. A method according to claim 1, wherein said assembly bearing seat has a bearing opening of the same diameter as the other bearing seats.

3. A method according to claim 1, wherein said assembly bearing cap is formed from one of sheet steel and plastic material.

4. A method according to claim 1, wherein two assembly bearings with assembly bearing seats and separate assembly bearing caps are provided for each camshaft, one of said assembly bearings being disposed at each axial end of each camshaft.

* * * * *